US006840419B2

(12) United States Patent
Penny et al.

(10) Patent No.: US 6,840,419 B2
(45) Date of Patent: Jan. 11, 2005

(54) ADJUSTABLE LOAD SUPPORT-MOUNTING DEVICE FOR A BACKPACK

(75) Inventors: James R. Penny, Arcata, CA (US); Scott R. Allen, Fieldbrook, CA (US)

(73) Assignee: Watermark PaddleSports, Inc., Arcata, CA (US)

( * ) Notice: Subject to any disclaimer, the term of this patent is extended or adjusted under 35 U.S.C. 154(b) by 0 days.

(21) Appl. No.: 10/382,352

(22) Filed: Mar. 4, 2003

(65) Prior Publication Data

US 2004/0065704 A1 Apr. 8, 2004

Related U.S. Application Data

(60) Provisional application No. 60/401,981, filed on Aug. 7, 2002.

(51) Int. Cl.[7] ..... A45F 3/04

(52) U.S. Cl. ..... 224/637; 224/631; 224/641

(58) Field of Search ..... 224/628, 631, 224/632, 633, 637, 641

(56) References Cited

U.S. PATENT DOCUMENTS

| | | | | |
|---|---|---|---|---|
| 3,653,566 A | | 4/1972 | Owens | |
| 3,831,827 A | | 8/1974 | Olson | |
| 4,154,381 A | | 5/1979 | Zufich | |
| 4,214,685 A | | 7/1980 | Pletz | |
| 4,303,186 A | | 12/1981 | Ollinger, IV | |
| 4,369,903 A | | 1/1983 | Wilkes | |
| 5,004,135 A | * | 4/1991 | Dufournet et al. | 224/632 |
| 5,419,473 A | * | 5/1995 | Lamar | 224/632 |
| 5,449,102 A | * | 9/1995 | Sason | 224/632 |
| 5,626,271 A | | 5/1997 | Messey et al. | |
| 5,806,740 A | * | 9/1998 | Carlson | 224/628 |
| 5,868,292 A | | 2/1999 | Stephens et al. | |
| 6,536,641 B1 | * | 3/2003 | Sundara et al. | 224/637 |

FOREIGN PATENT DOCUMENTS

| | | |
|---|---|---|
| CH | 2628 | 8/1890 |

* cited by examiner

*Primary Examiner*—Stephen K. Cronin
(74) *Attorney, Agent, or Firm*—Kolisch Hartwell, P.C.

(57) ABSTRACT

A mounting device for a backpack includes a first mounting element adapted to be connected to a load supported on a user's back, and a second mounting element adapted to be connected to a user's waist belt. The first mounting element is pivotable relative to the second mounting element to vary the vertical position of the waist belt during use relative to a load supported by the pack. A mechanism is configured to fix selectively the first mounting element relative to the second mounting element.

22 Claims, 3 Drawing Sheets

ADJUSTABLE LOAD SUPPORT-MOUNTING DEVICE FOR A BACKPACK

CROSS-REFERENCE TO RELATED APPLICATIONS

This application claims priority from U.S. Provisional Patent Application Ser. No. 60/401,981, filed Aug. 7, 2002 of Joseph J. Settelmayer and James R. Penny for a CHILD CARRIER PACK, the disclosure of which is hereby incorporated by reference.

BACKGROUND OF THE INVENTION

The present invention relates to the field of backpacks, and in particular to an adjustable device for mounting a waist belt to a load supported on a backpack. Backpacks are in common usage for hauling heavy loads, such as for carrying supplies for outdoor recreational use. Backpacks have also become common for using in carrying babies and young children. Using carriers designed to support children, they provide the child with a comfortable and secure ride while allowing the parent Or other carrier ease of mobility and free use of the hands.

In such uses, particularly in the instance of carrying a child, it is desirable for different people to wear the backpack, to share the burden of carrying the load. People have a wide variety of physical structures. The structural differences between men and women are particularly pronounced. The position of the pack on the shoulders and the position of the waist belt relative to a frame determine the balance of the pack on the back, the amount of the load supported through the waist belt, and the general comfort or fit of the backpack. As a result, different wearers prefer different relative positions between the waist belt and frame.

It is therefore desirable to be able to adjust the backpack to accommodate personal differences and preferences. A common adjustment that is desired is in the position of the waist belt relative to the load supported on the user's back, due to differences in sizes of the users' torsos. Various backpack structures are illustrated in U.S. Pat. Nos. 6,318,608; 6,199,732; 5,868,292; 5,626,271; 4,369,903; 4,303,186; 4,214,685; 4,154,381; 3,831,827; and 3,653,566, Swiss patent number 2628, and Norwegian patent number 68057, which are incorporated by reference.

Several of these patents disclose packs in which the waist belt is adjustable relative to the back frame. These adjustments often require the use of tools and are designed to be made by the user when the backpack has been removed. This is time consuming and may be awkward to accomplish while a child is supported in the pack. It is therefore desirable to be able to make adjustments in the position of the waist belt relative to the pack frame while the user is wearing the pack, and particularly to make the adjustments without the use of separate tools.

BRIEF SUMMARY OF THE INVENTION

The present invention is directed to a mounting for a waist belt of a backpack providing adjustment of the position of the waist belt relative to the load. More particularly, one aspect of the invention is directed to a mounting device for a backpack that includes a first mounting element adapted to be connected to a load supported on a user's back, and a second mounting element adapted to be connected to a user's waist belt. The first mounting element is pivotable relative to the second mounting element to vary the vertical position of the waist belt relative to a load supported by the pack. A mechanism is configured to fix selectively the first mounting element relative to the second mounting element.

A preferred embodiment of a backpack made according to the invention includes a frame having an upper portion and a lower portion. The frame has a bend between the upper and lower portions, Whereby the lower portion is displaced rearwardly of the upper portion. A pair of shoulder straps are attached to the upper portion of the frame. First and second mounting assemblies connect opposite sides of the lower portion of the frame to a waist belt. Each mounting assembly includes a first mounting element fixedly attached to the frame. A second mounting element is pivotably attached at a first position to the first mounting element for pivoting about a common pivot axis. The waist belt is attached to the second mounting element at a second position spaced from the first position. The first and second mounting elements have interlocking teeth circumferentially disposed about the pivot. A handle is used to disengage selectively the interlocking teeth, and thereby, to unlock the pivot to allow changing the position of the waist belt relative to the frame.

A particularly advantageous feature of this invention is that the position of the waist belt relative to a supported load is readily changed by pivoting of a support element. In a preferred embodiment, a handle is positioned to the side of a user wearing the backpack and is manipulable to selectively unlock the pivot for adjustment. Adjustment may thus be accomplished while the user is wearing the pack and belt, and the load and waist belt are readily fixed in the selected position after adjustment.

These and other features and advantages of the present invention will be apparent from the preferred embodiment described in the following detailed description and illustrated in the accompanying drawings.

DETAILED DESCRIPTION OF THE PREFERRED EMBODIMENT OF THE INVENTION

Figure 1:
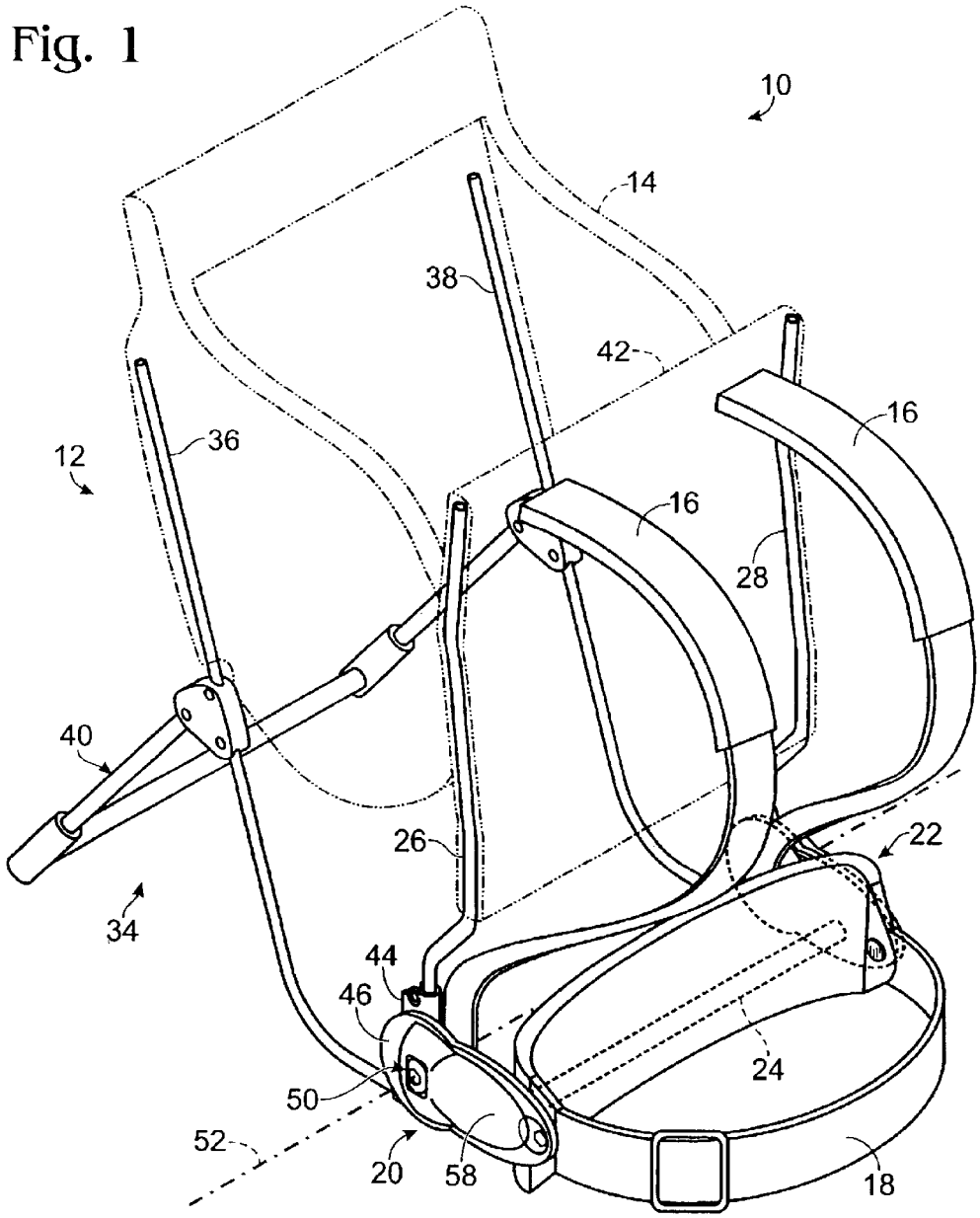
FIG. 1 is a perspective view of a backpack according to one embodiment of the invention.

As has been mentioned, the invention provides a mechanism for adjusting the position of a waist belt relative to a load supported on a backpack. A preferred embodiment of a backpack made according to the invention is shown generally at 10 in FIG. 1. Backpack 10, constructed as a child carrier, includes a frame 12, a load-support bag 14, shoulder straps 16, waist belt 18, opposite adjustment hubs 20 and 22, and connecting rod 24. Backpack 10 is shown in the position it would have when worn by a user in an upright standing or walking position. Accordingly, general reference will be made to the orientation or position of certain elements when the backpack is in this upright position. Such terms are thus used to make the relationships between elements of the backpack more readily understood, but are not to be taken as otherwise limiting descriptions. Clearly the backpack may be placed in other orientations. As a further convention, the portion of the backpack adjacent to a user wearing the pack is referred to as the front of the pack, and correspondingly the portion distant from the user is referred to as the rear of the pack.

Figure 2:
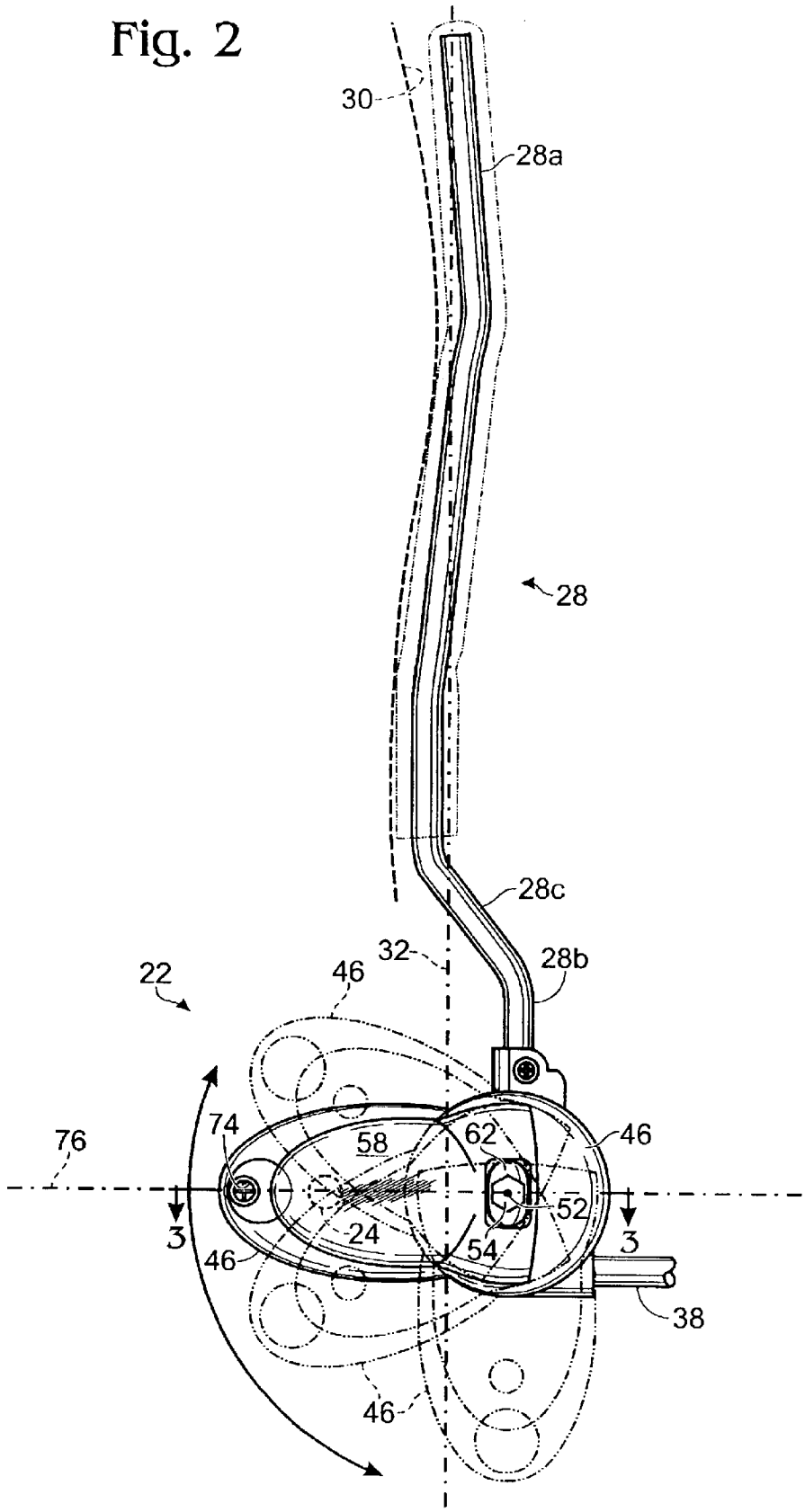
FIG. 2 is d side view of a portion of the backpack of FIG. 1 showing a frame member and an adjustment hub.

Frame 12 includes generally vertically oriented frame members 26 and 28 on respective opposite sides of the pack. Additional interconnecting members may also be provided, such as to anchor the top ends of shoulder straps 16 to the frame. A side view of frame member 28 is shown in FIG. 2. Member 26 has a corresponding shape. It is seen that member 28 has an upper portion 28*a* with a shape that generally conforms to a user's back, as indicated by outline 30. Although upper portion 28*a* is not planar, it is seen that it extends along a generally vertical or upright plane 32. The frame member also has a lower portion 28*b* that is displaced posteriorly of plane 32. The upper and lower portions are connected by a bend 28*c* generally in the form of an S-curve.

In order to accommodate the use of bag 14 as a child carrier, frame 14 also includes an outrigger 34 including bag-support members 36 and 38, and a folding leg assembly 40 that is pivotably connected to members 36 and 38 so that it may be retracted to a position against these members while the backpack is worn. The frame members may be suitably covered with protective material, such as a fabric cover 42. It will be appreciated that backpack frames and bags are made in a variety of styles, shapes and materials. Backpacks made in these other ways may also be made according to the invention.

Adjustment hubs 20 and 22 couple the bottom ends of respective frame members 26, 36 and 28, 38 together and to waist belt 18. The waist belt is also referred to as means for supporting a load on a user's waist. These hubs are also referred to as load-support mounting devices, as well as means for varying the vertical position of the belt relative to a load or the frame, as is explained further below.

Figure 3:
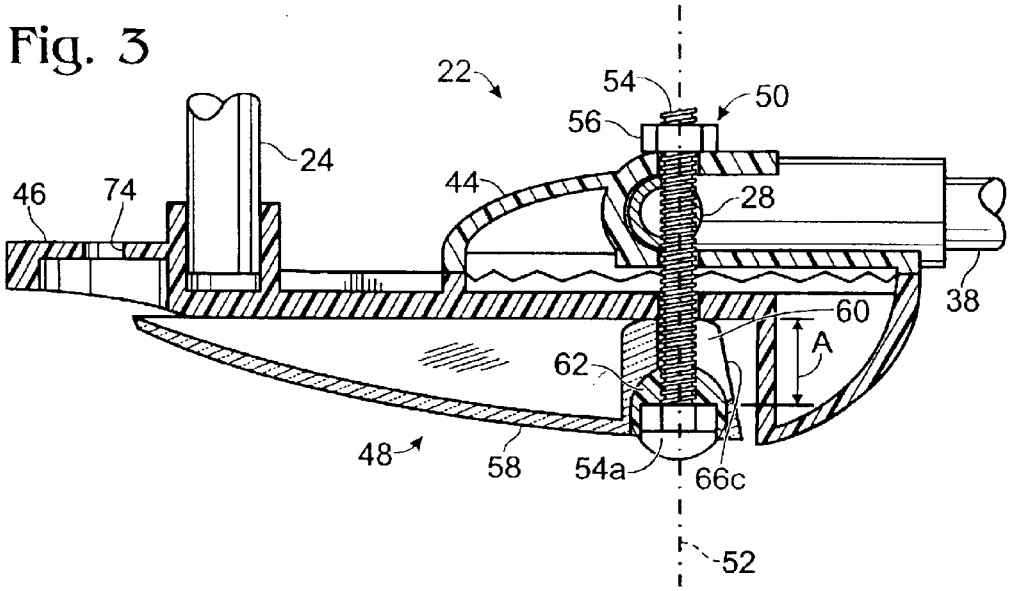
FIG. 3 is a cross section taken along line 3—3 of FIG. 2 illustrating a lock position of an adjustment hub.
Figure 4:
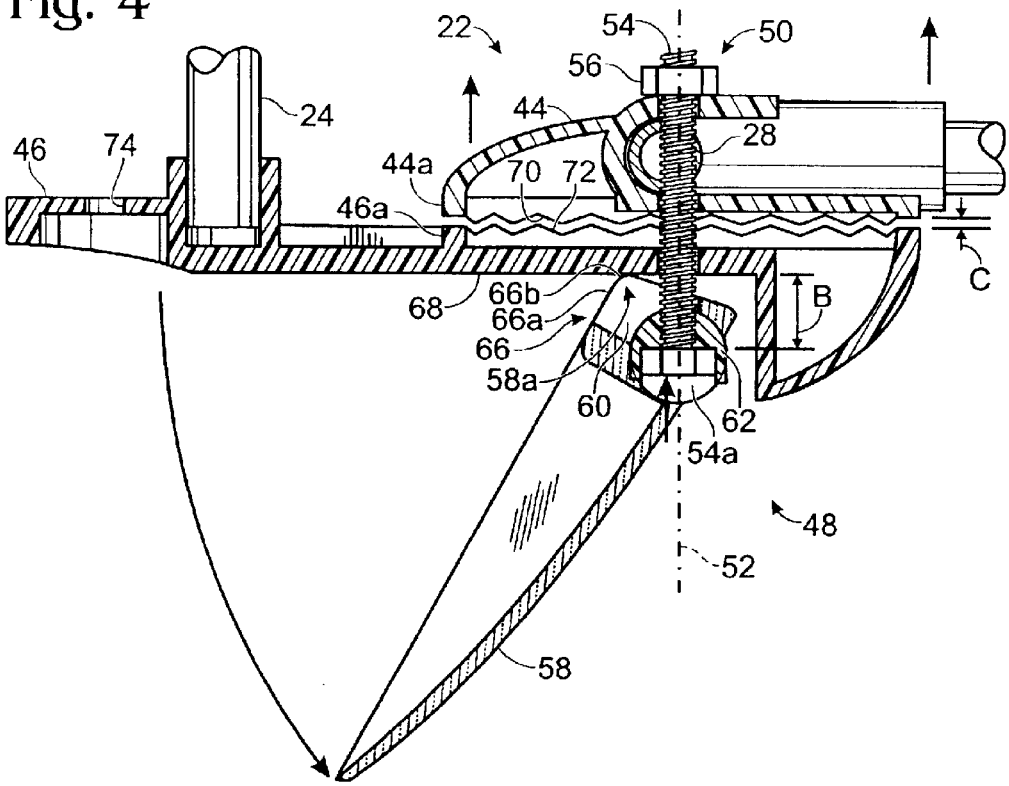
FIG. 4 is a cross section similar to FIG. 3 illustrating an unlock position of the hub.

Hub 22 is shown in greater detail in FIGS. 2-4. The two hubs are mirror images of each other, so the description of hub 22 also applies to hub 20. Hub 22 includes a first mounting element, referred to as a base 44, a second mounting element, referred to as an arm 46, a locking mechanism 48, and a pivot 50. Base 44 is fixedly attached to the lower ends of frame members 28 and 38 and pivotally attached to arm 46 by pivot 50. Base 44 may thus be considered to be a part of frame 12. Pivot 50 provides for pivoting of arm 46 about a pivot axis 52. In this embodiment, the pivot axes of the two hubs are preferably coaxial, so that the arm of hub 20 also pivots about axis 52. Pivot 50 includes a shaft 54, in the form of a bolt having a head 54*a* and a nut 56. The shaft passes through corresponding holes in the arm and base to allow the arm and base to freely pivot relative to each other when locking mechanism 48 is in an unlocked state, as discussed below.

Locking mechanism 48, also referred to as means for locking, works through shaft 54 to fix selectively the arm relative to the base or frame. The locking mechanism includes a handle 58 having a slot 60 through which shaft 54 passes. A resilient washer 62, captured between shaft head 54*a* and handle 58, urges the handle toward arm 46. Handle 58, also referred to as a lock element, has a lock position, as shown in FIG. 3, and an unlock position, as shown in FIG. 4. Slot 60 is configured to allow shaft 54 to move between these positions.

A cam or eccentric surface 66 in handle 58 includes a surface portion 66*a* that is seated against a handle-support surface 68 of base 44 when the handle is in the lock position shown in FIG. 3. In the lock position, handle 58 holds shaft head 54*a* away from arm 46 by a distance A. When the handle is in the lock position it lies flush against arm 46. As the handle is pivoted outwardly toward the unlock position shown in FIG. 4, washer 62 is compressed and an intermediate cam surface portion 66*b*, associated with a shoulder 58*a* of the handle, presses against surface 68. The handle is thus used as a lever to overcome the force of the washer urging the handle into the lock position.

Once the handle is moved so that arm surface 68 contacts a portion 66*c* of handle surface 66 past shoulder 58*a*, the washer returns to its relaxed state. When the handle is in this unlock position, arm 46 is free to move axially along pivot axis 52 away from base 44. The head 54*a* of the shaft is now at a reduced distance B from arm 46 and there is a space between the base and arm represented by a distance C. This is the position of the handle shown in FIG. 4. Arm 46 is free to-pivot relative to base 44 about shaft 54.

Exemplary alternate pivot positions are shown in dashed lines in FIG. 2. When the handle is in the lock position shown in FIG. 3, the arm is fixed in one of the many possible positions relative to the base.

The mechanism for preventing pivoting of the arm relative to the base or frame, when the handle is in the lock position, will now be explained. Base 44 has an annular ridge 44*a* facing arm 46. The ridge has a center on pivot axis 52. Formed in ridge 44*a* is a continuous row of teeth 70. Similarly, arm 46 has an annular ridge 46*a* facing ridge 44*a*. Ridge 46*a* also has a continuous row of teeth 72 configured to mesh with teeth 70 when arm 46 is pressed against base 44. Interlocking teeth 70 and 72, also referred to as opposing surfaces, prevent relative rotation between the base and arm when the handle is in the lock position.

It will be appreciated that other devices may be used to selectively lock the mounting elements (base and arm) from relative movement. For instance, one or more pins or teeth mounted on one of the mounting elements could be releasably positioned in one of a plurality of holes or detents in the other mounting element. These devices could act radially or axially. A friction device, such as a form of clutch or brake, could also be used.

The end of arm 46 spaced from pivot axis 52 has an opening 74 for use in attaching the end of the arm to a waist belt. The pivot is located in the arm at what is referred to as a first position, and opening 74 is at a second position spaced from the first position. When the arm is pivoted about the pivot axis, as is illustrated in FIG. 2, it is seen that the arm end changes elevation, also referred to as a vertical position, thereby changing the position of the waist belt relative to the pack frame and a load supported on the frame.

As discussed previously, connecting rod 24, also referred to as a connecting element, extends between the arms of hubs 20 and 22. This rod keeps the two arms in circumferential alignment about common pivot axis 52. It is not necessary that the rod connects the two arms or that the pivot axes of the two hubs be coaxial. These features do however provide improved ease of adjustment of the hubs.

It is also not required that plane 32, along which upper portion 28*a* of the frame is disposed, be displaced from pivot axis 52. However, it has been found that, when the pivot axis lies in plane 32, frame members 26 and 28 tend to pivot generally about a line passing through the upper ends of these frame members. By displacing pivot 50 to the rear of plane 32, this pivoting is reduced substantially. It is preferred that plane 32 pass through a line 76 extending between pivot 50 and opening 74, when arm 46 is disposed generally horizontally, as shown in FIG. 2. This puts the plane more in alignment with the waist belt connection, represented by opening 74, as the Waist belt connection pivots around pivot axis 52. The greatest separation between the plane and the connection is when the arm is horizontal. As the connection moves up or down it moves closer to the plane. The closer the connection is to the plane, the less the frame seems to pivot.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

The invention claimed is:

1. An adjustable load support-mounting device for a backpack comprising:

a first mounting element adapted to be connected to a load supported on a user's back;

a second mounting element adapted to be connected to a user's waist belt, the first mounting element being pivotable relative to the second mounting element to vary the vertical position of the waist belt relative to the load; and a mechanism configured to fix selectively the first mounting element relative to the second mounting element.

2. The device of claim 1, wherein the second mounting element is pivotally connected to the first mounting element at a first position and is adapted to be connected to the user's waist belt at a second position spaced from the first position.

3. The device of claim 1, wherein the mechanism includes a plurality of opposing surfaces that are selectively moveable between a first relative position in which the surfaces contact to fix the first mounting element relative to the second mounting element and a second relative position in which the surfaces are spaced apart, allowing the first mounting element to pivot relative to the second mounting element.

4. The device of claim 3, wherein the opposing surfaces are attached to the first and second mounting elements, and the first and second mounting elements pivot about a pivot axis and move relative to each other along the pivot axis when the opposing surfaces move between the first and second relative positions.

5. The device of claim 3, wherein the mechanism includes a lock element moveable between a lock position in which the opposing surfaces are held in the first relative position and an unlock position in which the opposing surfaces are allowed to move toward the second relative position.

6. The device of claim 5, wherein the lock element is resiliently biased toward the lock position.

7. The device Of claim 1, wherein the mechanism includes a lock element moveable between a lock position in which the first mounting element is fixed relative to the second mounting element, and an unlock position in which the first mounting element is pivotable relative to the second mounting element.

8. The device of claim 7, wherein the lock element is resiliently biased toward the lock position.

9. The device of claim 7, wherein the lock element lies flush against one of the first and second mounting elements when in the lock position.

10. The device of claim 1, wherein the lock element is pivotable along a cam surface for locking and unlocking the hub.

11. An adjustable load support-mounting device for a backpack comprising:

first means for supporting a load on a user's back;

second means for supporting a load on a user's waist;

means coupled to the first and second supporting means at spaced positions for varying the vertical position of the second supporting means relative to the first supporting means by pivoting the first supporting means relative to the second supporting means; and means for locking selectively the varying means.

12. A load support system for supporting a load on a user's back, the load support system comprising:

a frame adapted to be connected to a load and worn by the user, the frame having a lower portion with opposite sides adjacent to a user's waist when the frame is in an upright position during wearing by a user;

a waist belt configured to encircle the user's waist;

first and second mounting elements respectively pivotally mounted relative to the opposite sides of the frame, each mounting element being connected to the belt at a position spaced from the frame, whereby pivoting the mounting element relative to the frame varies the vertical position of the belt relative to the frame; and a first mechanism configured to fix selectively the first mounting element relative to the frame.

13. The system of claim 12, further comprising a second mechanism configured to fix selectively the second mounting element relative to the frame.

14. The system of claim 13, wherein the first and second mounting elements pivot coaxially relative to the frame.

15. The system of claim 14, wherein the first and second mounting elements are coupled together.

16. The system of claim 14, further comprising a connecting element extending between the first and second mounting elements to keep the mounting elements in circumferential alignment.

17. The system of claim 12, wherein the first and second mounting elements are mounted relative to the frame along a first axis, and the frame includes an upper portion extending, when worn by a user, along a generally vertically oriented plane that is generally horizontally displaced from the first axis.

18. The system of claim 17, wherein the plane is displaced anteriorly from the first axis.

19. The system of claim 18, wherein the frame curves posteriorly below the upper portion.

20. The system of claim 17, wherein the plane passes between the first axis and a line connecting the positions where the mounting elements are connected to the belt, when the line is generally at the same horizontal level as the axis.

21. The system of claim 12, wherein the frame includes an upper portion extending along a generally vertically oriented plane and the upper portion is displaced anteriorly of the lower portion.

22. A backpack for supporting a load on a user's back, the backpack comprising:

a frame adapted to be positioned adjacent to the back when connected to a load and worn by the user, the frame having an upper portion and a lower portion having opposite sides, the frame having a bend between the upper and lower portions, whereby the lower portion is displaced rearwardly of the upper portion;

a pair of shoulder straps attached to the upper portion of the frame;

a waist belt configured to encircle the user's waist; and first and second mounting devices, each mounting device connecting a respective side of the lower portion to the waist belt, and including:

a first mounting element fixedly attached to a respective side of the lower portion of the frame, a second mounting element pivotably attached at a first position to the first mounting element for pivoting about a common pivot axis and attached to the waist belt at a second position spaced from the first position, the first and second mounting elements having interlocking teeth circumferentially disposed about the pivot axis, and a handle coupled to the first and second mounting elements and having a cam surface forming a detent with a lock position in which the first and second mounting elements are pressed together causing the teeth of the first and second mounting elements to interlock, thereby preventing pivoting of the second mounting element relative to the first mounting element, and an unlock position in which the second mounting element may be axially displaced from the first mounting element, thereby disengaging the interlocking teeth and allowing the second mounting element to be pivoted relative to the first mounting element, the handle being flush against the second mounting element in the lock position and extending away from the second mounting element in the unlock position.

* * * * *